US011638473B2

(12) United States Patent
Bickford

(10) Patent No.: US 11,638,473 B2
(45) Date of Patent: May 2, 2023

(54) PLEATED COSMETIC TOOL

(71) Applicant: L'OREAL, Paris (FR)

(72) Inventor: William Bickford, Clark, NJ (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 16/861,785

(22) Filed: Apr. 29, 2020

(65) Prior Publication Data

US 2021/0337951 A1 Nov. 4, 2021

(51) Int. Cl.
*A46B 5/02* (2006.01)
*A45D 34/04* (2006.01)
*A45D 40/26* (2006.01)

(52) U.S. Cl.
CPC ..... *A45D 34/04* (2013.01); *A45D 40/26* (2013.01); *A45D 2200/1036* (2013.01)

(58) Field of Classification Search
CPC ..... A45D 34/04; A45D 40/26
USPC ..... 401/6
See application file for complete search history.

(56) References Cited

U.S. PATENT DOCUMENTS 3,385,746 A 5/1968 Rohn
6,165,242 A 12/2000 Choi
7,235,115 B2 6/2007 Duffy et al.
7,263,740 B2 * 9/2007 Crisswell ..... E04F 21/162 15/235.6
7,310,850 B2 * 12/2007 Ge ..... A47K 7/026 15/111
7,454,813 B2 * 11/2008 Kaltenegger ..... A47L 13/16 15/210.1
7,691,760 B2 * 4/2010 Bergsten ..... B32B 27/12 442/149
7,779,847 B2 * 8/2010 Castagno ..... A46B 9/005 132/200
7,896,940 B2 3/2011 Sundet et al.
8,419,817 B2 4/2013 Sundet et al.
8,429,782 B2 * 4/2013 Russo ..... B24B 23/04 15/97.1
8,689,387 B2 4/2014 Gundersen
2004/0231086 A1 * 11/2004 Watkins ..... B44D 3/162 15/236.06

(Continued)

FOREIGN PATENT DOCUMENTS

EP 1661483 A1 5/2006
JP 2003310337 A 11/2003

(Continued)

OTHER PUBLICATIONS

Preliminary Search Report, dated Feb. 23, 2021, issued in corresponding French Application No. 2006841, 2 pages.

(Continued)

*Primary Examiner* — Jennifer C Chiang
(74) *Attorney, Agent, or Firm* — Christensen O'Connor Johnson Kindness PLLC

(57) ABSTRACT

A pleated or corrugated cosmetic tool is disclosed. Generally, the cosmetic tool may be used to apply or remove a wide variety of cosmetic formulas to the human body, including face, eyelashes, eyelids, eyebrows, fingernails, toenails, lips, and other body parts. The pleated or corrugated cosmetic tool defines an undulated contact or application surface. The undulating contact application surface may allow the tool to smoothly and dynamically adapt to contours of the user's face, legs, arms, or other body parts.

16 Claims, 5 Drawing Sheets

(56) References Cited

U.S. PATENT DOCUMENTS

| | | | | |
|---|---|---|---|---|
| 2007/0256267 | A1* | 11/2007 | Burnett | A47L 13/20 15/229.1 |
| 2010/0242201 | A1* | 9/2010 | Linzell | D04H 3/045 15/229.11 |

FOREIGN PATENT DOCUMENTS

| | | | |
|---|---|---|---|
| KR | 101795372 | B1 | 11/2017 |
| WO | 99/29206 | A1 | 6/1999 |

OTHER PUBLICATIONS

Written Opinion, dated Feb. 23, 2021, issued in corresponding French Application No. 2006841, 4 pages.

* cited by examiner

PLEATED COSMETIC TOOL

SUMMARY

The present disclosure is directed to, among other things, representative embodiments of a tool for applying or removing a cosmetic formula, hair, skin, and the like.

In accordance with an embodiment of the present disclosure, a cosmetic tool is provided, which comprises a material body having an undulating application surface, and a handle coupled to the body.

In accordance with another embodiment of the present disclosure, a cosmetic tool is provided, which comprises a mandrel, an array of pleats on a first end of the mandrel, and a handle coupled to a second end of the mandrel.

In accordance with another embodiment of the present disclosure, a cosmetic tool is provided, which comprises a substrate with a first side and a second side, a material body attached to the first side of the substrate and having an undulating contact surface.

In any embodiment of the present disclosure, the undulating application surface is formed by one of a pleated material and a corrugated material.

In any embodiment of the present disclosure, the cosmetic tool further comprises a backing affixed to the material body, wherein the backing is arranged in pleats to mimic the undulating application surface of the material body.

In any embodiment of the present disclosure, the cosmetic tool further comprises a substrate disposed in-between the material body and the handle.

In any embodiment of the present disclosure, the substrate is one of a linear shape, a convex shape, and a concave shape.

In any embodiment of the present disclosure, the substrate is flexible.

In any embodiment of the present disclosure, the undulated contact surface includes a plurality of pleats, each pleat having a peak.

In any embodiment of the present disclosure, a fullness of the pleats is between 10% fullness and 100% fullness.

In any embodiment of the present disclosure, the plurality of pleats vary in height, width or depth.

In any embodiment of the present disclosure, the pleats are formed by a pleated fabric.

In any embodiment of the present disclosure, the size of the pleats is non-constant.

In any embodiment of the present disclosure, a height of the pleats varies around a perimeter of the mandrel.

In any embodiment of the present disclosure, the substrate is semi-rigid.

In any embodiment of the present disclosure, the substrate is rigid.

In any embodiment of the present disclosure, the cosmetic tool further comprises a handle attached to the second side of the substrate.

In any embodiment of the present disclosure, the material body includes one or more fabrics.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The following description provides several examples that relate to a pleated or corrugated cosmetic tool. Generally, the tool may be used to apply or remove a wide variety of cosmetic formulas to the human body, including face, eyelashes, eyelids, eyebrows, fingernails, toenails, lips, and other body parts. Some examples of cosmetic formulas to remove or apply include mascara, eyeliner, eye shadow, blush, foundation, concealer, bronzer, highlighter, nail polish, lipstick, lip gloss, etc. In some instances, the tool may aid in the application of a cosmetic formula. In other embodiments, the tool may be used to remove a cosmetic formula, hair, dead skin cells, calluses, and the like. The tool may be specific to a particular application or use or may be generally used for multiple functions. While it is generally understood the embodiments described herein can be used to apply or remove a cosmetic formula, for ease, the remaining description will reference only removal.

Figure 1:
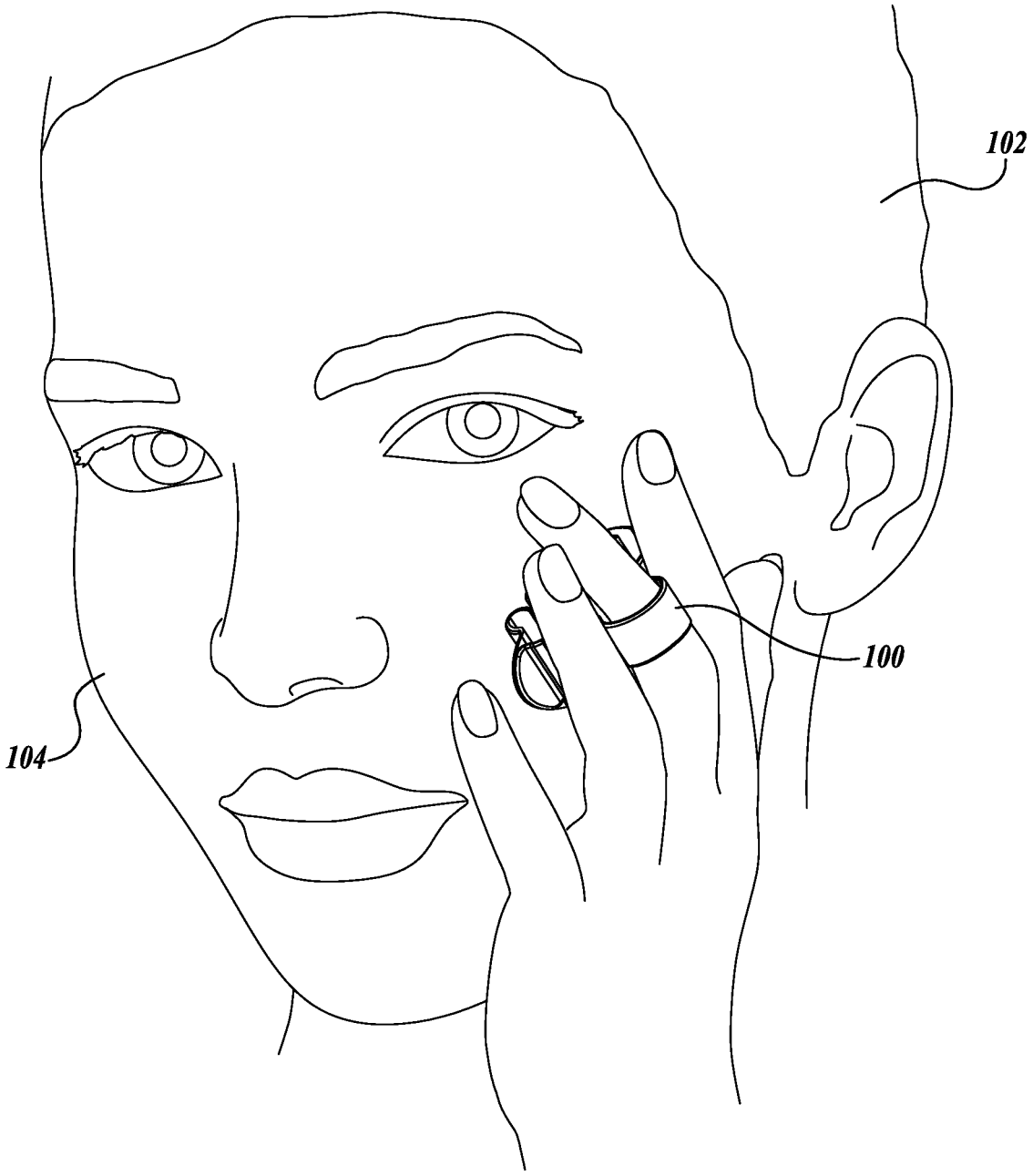
FIG. 1 is a schematic representation of a cosmetic tool in accordance with an embodiment of the present disclosure.

FIG. 1 depicts one representative example of a cosmetic tool 100 formed in accordance with an aspect of the present disclosure. As shown in FIG. 1, a user 102 may use the tool 100 to remove a cosmetic formula from their face 104. For some users, traditional wipes, pads, tools, or removers may provide or administer too much surface friction between the wipe and the skin. This may result in agitated skin, acne, or other sensitive skin issues. The tool 100 as shown and described herein, may include an undulating application surface. For example, the undulating application surface may be either a pleated or a corrugated application surface. As used herein, the term "application surface" includes, but is not limited to, any surface that is capable of contacting the user for either application or removal of a cosmetic formula.

The undulating application surface may allow the tool 100 to smoothly and dynamically adapt to contours of the user's face, legs, arms, or other body parts. The dynamic ability of surface of the tool 100 to adapt to the user's skin aims to reduce the amount of friction between the tool 100 and the user's skin. Reducing friction may result in less inflammation and/or irritation to the user's skin which could result in less breakouts, redness, swelling, capping, or other undesirable skin conditions.

In some embodiments, the undulating application surface of the cosmetic tool 100 may additionally increase the amount of surface area contacting the skin during use. The increased surface area may result in a greater amount of product being removed per pass, which may result in fewer passes of the tool 100 resulting in reduced skin irritation. In other embodiments, the undulating application surface, which may be formed, for example, via a pleated or corrugated structure, may additionally enable the medium to be flexible. Therefore, the tool 100 may traverse compound or complex surfaces such as knees, elbows, ankles, and the like and maintain skin contact during the traverse. The ability to easily traverse complex areas may also reduce skin irritation. In some embodiments, the tool 100 may also be depilatory and the undulating application surface, such as the pleats or corrugations, may enable the user to easily remove more hair more quickly.

Turning now to FIG. 2-7, various embodiments of a cosmetic tool, generally designated 200, suitable for such uses as tool 100 or others, will be described in more detail. Each tool 200 of FIGS. 2-7 includes an undulating application surface 202 formed, for example, by pleats or corrugations 210. The following description may refer to undulating application surface 202 as "pleated surface 202" or "corrugated surface 202."

Generally described, the undulating application surface 202 forms alternating ridges and grooves, sometimes referred to as peaks and valleys, to increase the effective surface area for cleansing, exfoliation, and/or removal of make-up, dirt, sebum/skin, oil, or hair. In pleated embodiments, the pleats 210 may be a type of knife pleat, organ pleat, rolled pleat, accordion pleat, sunray pleat, or the like. Accordion and crystal pleats are smaller versions of knife pleats. A sunray pleat may have any cross-sectional shape but a width of the pleat, as discussed below, may widen along a length of the pleated surface.

Figure 2:
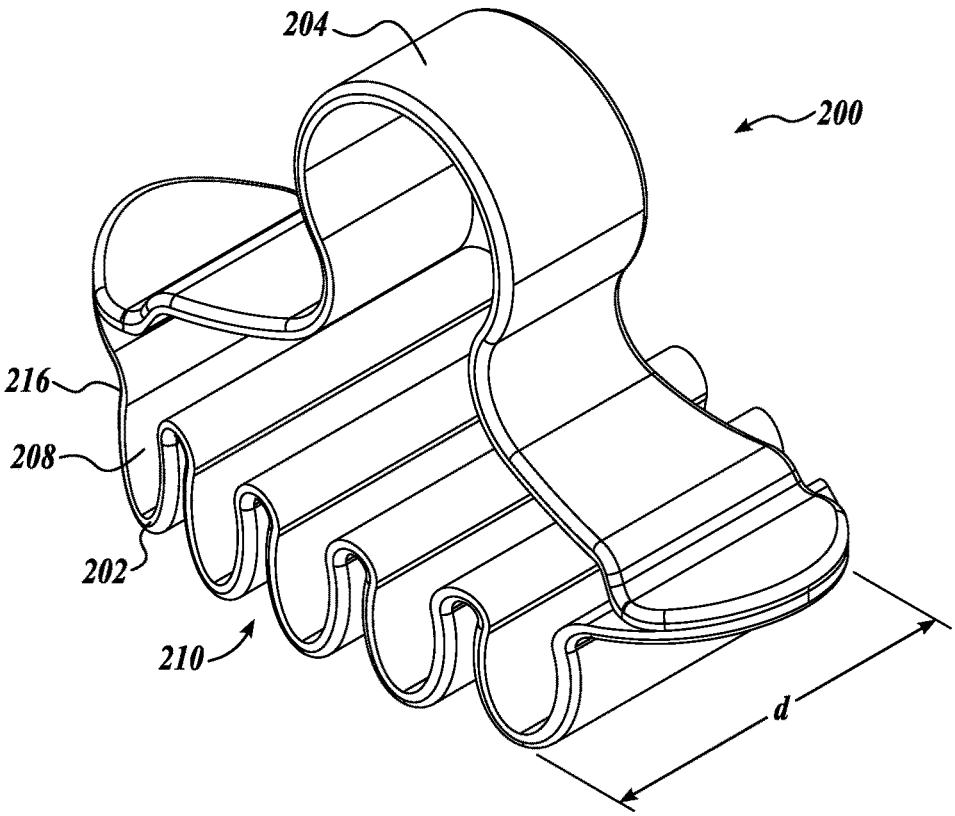
FIG. 2 is a perspective view of a cosmetic tool in accordance with an embodiment of the present disclosure.
Figure 3:
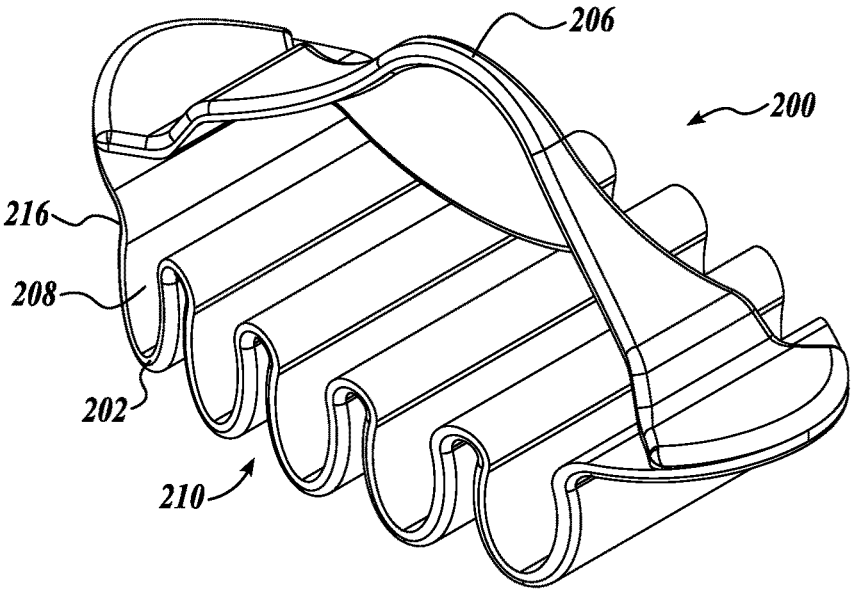
FIG. 3 is a perspective view of a cosmetic tool in accordance with another embodiment of the present disclosure.
Figure 4:
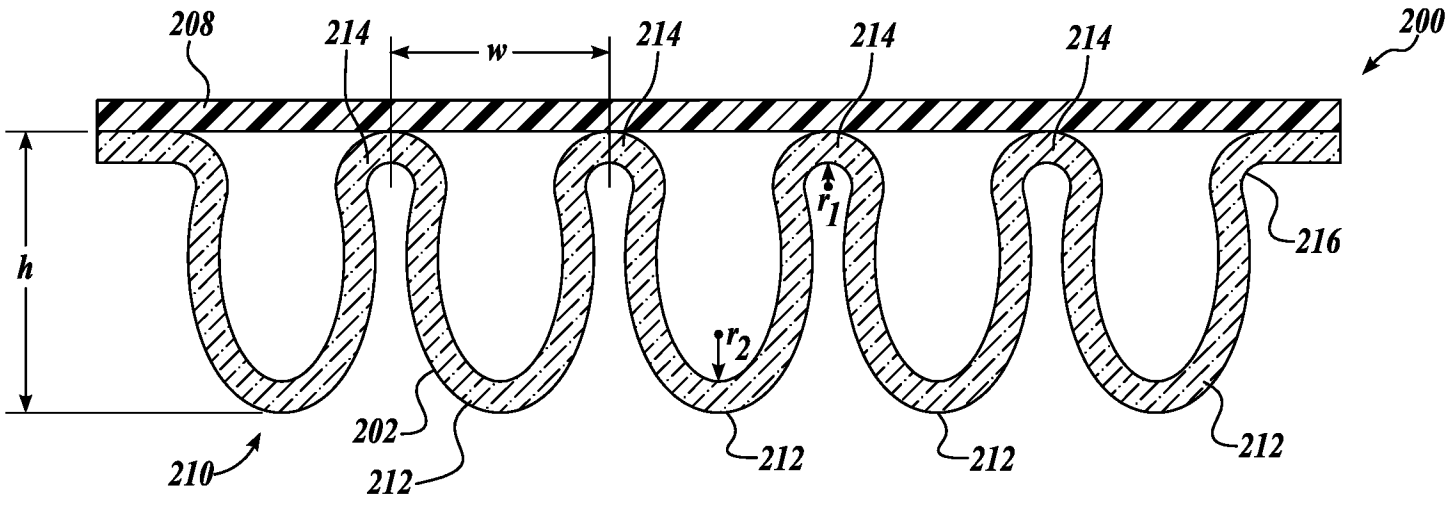
FIG. 4 is a side view of a cosmetic tool in accordance with another embodiment of the present disclosure.
Figure 5:
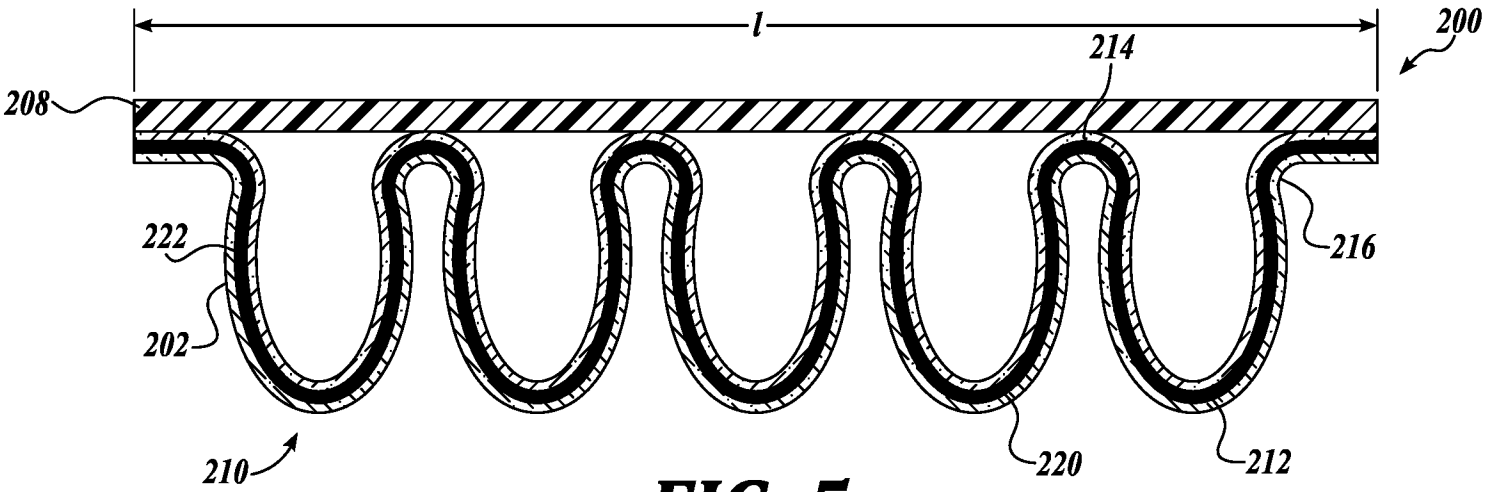
FIG. 5 is a side, cutaway view of a cosmetic tool in accordance with an embodiment of the present disclosure.

As shown in FIGS. 2 and 3, a body 216 defining or including the undulating application surface 202 may be coupled to a handle, such as handle 204 or handle 206, respectively. In some embodiments, as shown in FIGS. 4 and 5, the body 216 may be supported by a substrate 208. In other embodiments, the body 216 may be free floating, as shown in FIGS. 2 and 3. In the embodiment shown in FIGS. 6 and 7, the undulating application surface 202 of the cosmetic tool 200 may have pleats or corrugations 210 arranged annularly around a mandrel 218. In some embodiments, the mandrel 218 may be coupled to a handle 220. In this embodiment, the pleats or corrugations 210 may therefore form a cylindrical, undulating application surface 202.

The undulating application surface 202 may be characterized by a variety of features. For example, as demonstrated in FIG. 4, the pleats or corrugations 210 of undulating application surface 202 may have a height (h) that extends from a bottom or valley 214 of the pleat or corrugation 210 to a top or peak 212 of the pleat or corrugation 210. The height (h) may be either uniform or non-uniform across the length (l) (see FIG. 5) of the undulating application surface 202. For example, in some embodiments, the height (h) may increase or decrease across the length of the undulating application surface 202. In still further embodiments, the height (h) may be symmetrical about an axial centerline (normal to the substrate 208), wherein the height (h) may increase to a first height and then decrease to a starting height along the undulating application surface 202.

Similarly, the pleats or corrugations 210 may also have a width (w), which may be measured, for example, from between adjacent valleys 214. In some embodiments in which the pleats or corrugations 210 are symmetrical, the width (w) is constant throughout the undulating application surface 202. In other embodiments in which the undulating application surface 202 includes pleats or corrugations 210 that are not symmetrical, one or more pleats or corrugations may have a first width while another one or more pleats or corrugations may have a second width that is less than the first width. The pleat or corrugation 210 may further have a radius ($r_1$) which may define a curvature of the valley 214. The pleat or corrugation 210 may further have a radius ($r_2$) which may define a curvature of the peak 212. In some embodiments, the peak or valleys 212, 214 may be essentially a point with a very small radius. In other embodiments, the peaks and/or valleys 212, 214 may have a large radius resulting in, for example, the rolled pleat or organ pleat or the like. In still further embodiments the radius(es) may change along a length 1 of the undulating application surface 202.

In some embodiments, the undulating application surface 202 may have varying depth (d) as shown in FIG. 2. In other embodiments, the undulating application surface 202 may have a constant depth (d).

Figure 7:
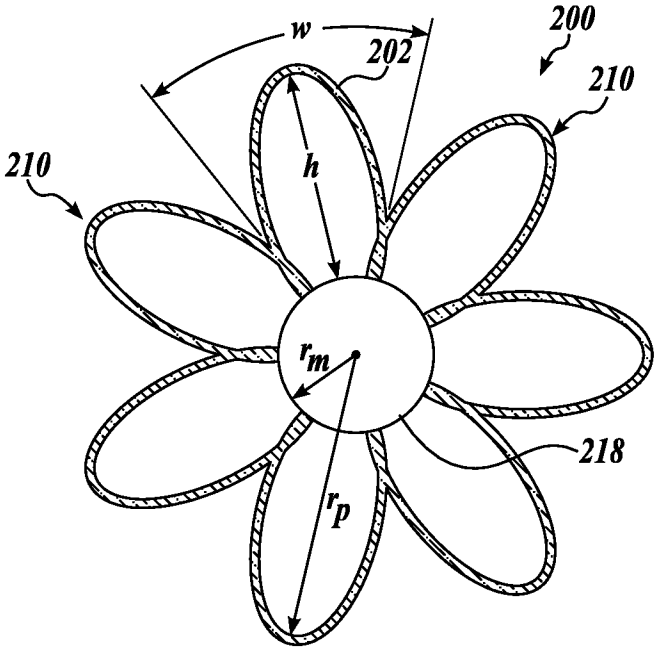
FIG. 7 is a cutaway view of the cosmetic tool shown in FIG. 6.

The pleats or corrugations 210 of the embodiment of FIG. 7 may also have several distinguishing features. For example, the pleats or corrugations 210 may have a height (h), angular width (w), and radius ($r_p$). The measurements and geometry of the pleats or corrugations 210 may depend on the size of the mandrel 218. For instance, the example shown is a mascara wand, but the pleats or corrugations 210 may be applied to a larger mandrel such as a rounded hairbrush mandrel, or an even larger mandrel focusing on larger body parts. Therefore, the mandrel 218 may vary in size from a mascara wand to a hair curler.

In some embodiments, the mandrel 218 may have a ½ mm base to a 100 mm or larger base. In this embodiment, the height (h) of pleats or corrugations 210 on a mandrel 218 may be defined by a first radius ($r_m$) defining an inner dimension of the pleats or corrugations 210 and a second radius ($r_p$) defining the outer radius of the pleats or corrugations 210. The pleats or corrugations 210 may also be defined by a radial distance (w) between adjacent valleys of the pleats or corrugations 210.

Figure 8:
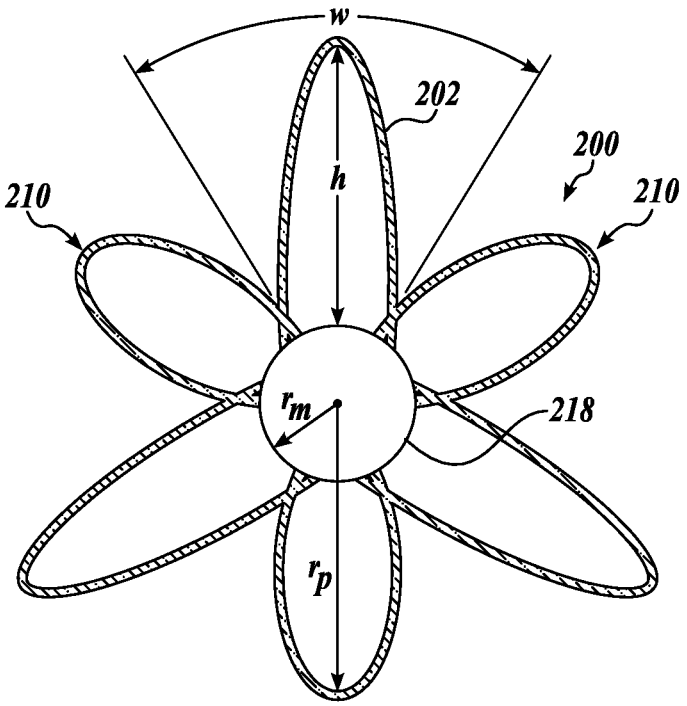
FIG. 8 is a cutaway view of the cosmetic tool shown in FIG. 6 showing pleats with non-constant size and/or height.

In some embodiments, the pleats or corrugations 210 may be fairly uniform either across a linear surface or arrayed on a mandrel. In further embodiments, the pleats or corrugations 210 may vary either across or around a surface. For example, in some embodiments, the pleats or corrugations 210 may be syncopatic wherein a pleat or corrugation may be absent or missing. This may provide greater flexibility in the cleansing surface or a break in the cleansing surface. In other embodiments, the pleats or corrugations 210 may change in shape, form, or size. For example, as the pleats or corrugations 210 travel across the linear path, or around a mandrel, the pleats or corrugations 210 may increase in depth (d), width (w), and/or height (h), as described above, and shown, for example, in FIG. 8. The pleats or corrugations 210 may gradually increase across a length (l) of the application surface. In some embodiments, the pleats or corrugations 210 may start large and then become smaller and then increase in size again. In still further embodiments, each pleat or corrugation 210 may have a different depth, height and/or width from the next pleat.

The pleats or corrugations 210 may be constructed from any pleated or corrugated material or materials. The material(s) may be hydrophobic or oleophobic. In some embodiments, the material(s) may be degradable and comprise a pulp material. The material(s) may also comprise a porous foam material or a 3D printed solid material. The material(s) may be injection molded, flexible, rigid, fabric, mesh, non-woven, foamed, extruded, or thermoformed. In some embodiments, the pleats or corrugations include one or more fabrics.

The pleats or corrugations 210 may conform to most any shape. As previously discussed, the pleats or corrugations may adapt to a flat or rounded surface. However, the pleats or corrugations may further adapt to abnormal surfaces, curved, convex, or concave surface.

The pleats or corrugations 210 may be fixed to a flexible, semi-rigid, or rigid support surface, such as a substrate 208 or mandrel 218, which may or may not provide the final surface shape of the pleats or corrugations. The substrate 208 may vary from negligible stiffness to substantially stiff depending upon the application and tool usage. For example, in some embodiments, an exfoliating face wipe may be best suited with a negligible stiffness and no handle. In further embodiments, a depilatory tool may perform best with a stiff substrate 208 and a flexible handle 206. Therefore, the substrate 208 may vary, for example, from a piece of fabric to a polymer, plastic, bamboo, or other stiff material.

Figure 6:
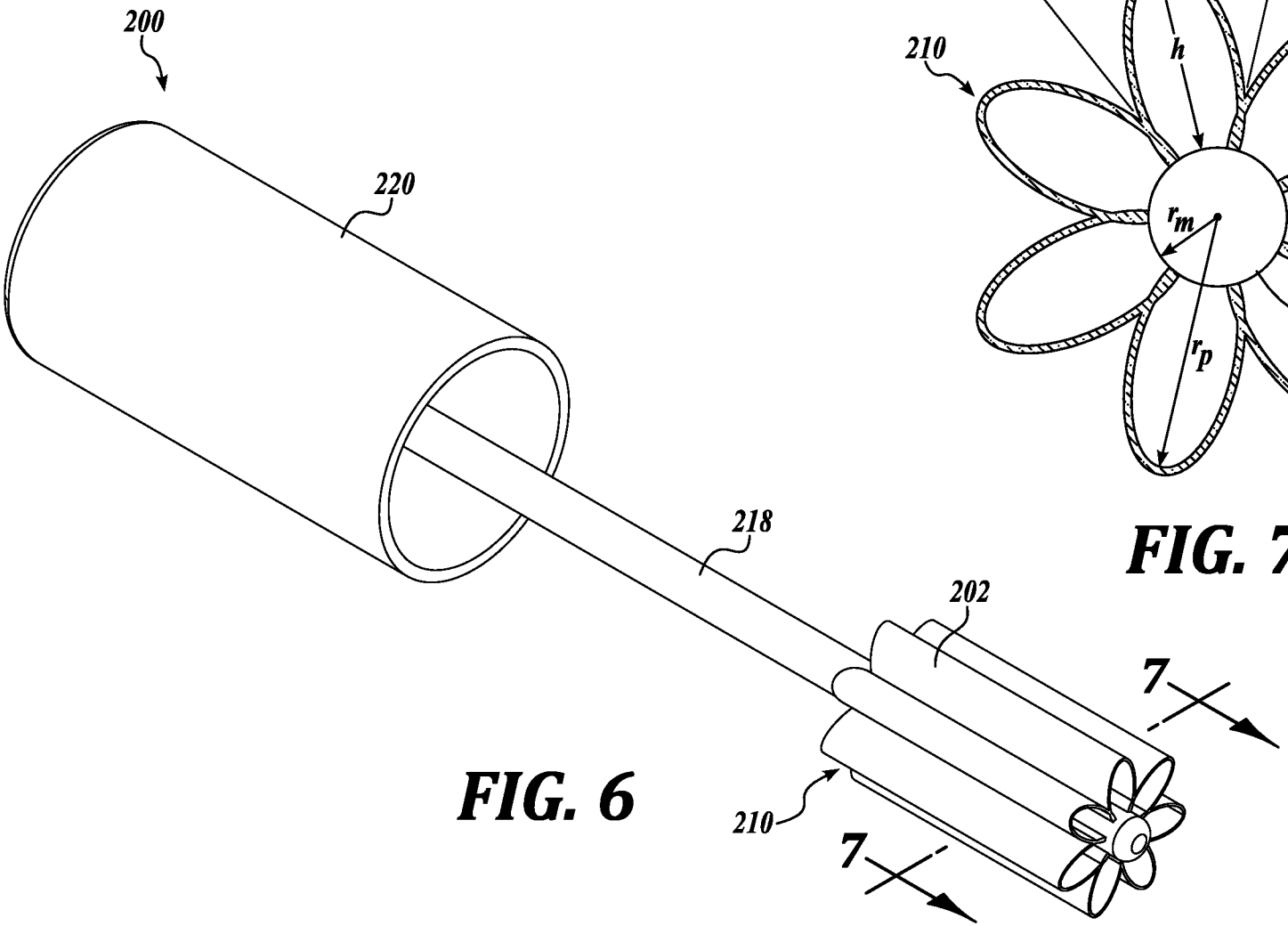
FIG. 6 is an isometric view of a cosmetic tool in accordance with another embodiment of the present disclosure.

The substrate 208 may be used with or without a handle 204, 206. Similarly, the arrayed pleats 210 of FIG. 6 may be supported by the mandrel 218 acting as the substrate, which may have an inherent stiffness. The mandrel 218 may comprise a polymer, plastic, wood, or other material providing some rigidity to the overall shape of the tool 200. The mandrel 218 may incorporate a handle 220, as shown in FIG. 6, to provide a user with a larger or easier gripping surface.

In some embodiments, the pleats or corrugations 210 may either be treated with a stiffening agent or comprise a stiffening material which may enable the pleats or corrugations to hold their shape without a substrate or to provide a more rigid pleated application surface. As shown in FIG. 5, the pleats or corrugations 210 may have a backing 222 which may provide structure, stiffness, or both to the pleats or corrugations 210. For example, in one embodiment, the pleating material may adhere to or be otherwise affixed to the backing 222, or in some embodiments, the backing 222 may be integrated into the pleating material. The backing 222 may comprise a total backing to the application surface 202 or bonding along the back of the surface 202. The backing 222 may comprise a variety of materials depending on a final desired stiffness of the application surface 202.

As briefly described above, in some embodiments, the pleated or corrugated material may comprise a plurality of materials. For example, the material may comprise a fabric, nonwoven, foam, bamboo, cactus fillers, cellulous material, hybrid materials, or the like. In some embodiments, the material may have a pile ranging between about 0 and about 10 mm, for example.

Embodiments of the undulating application surface 202 described herein may increase the amount of surface area normally present in a typically two-dimensional area. For example, if a normal tool surface area is approximately two square inches, replacing the two-dimensional surface with an undulating application surface 202 may increase the total contact surface area of the tool 200. The increased surface area may result, for example, in an increase the effective surface area for cleansing, exfoliation, and/or removal of make-up, dirt, sebum/skin, oil, or hair The total amount of surface area gained by using the undulating application surface 202, such as a pleated or corrugated surface, depends, for example, on their fullness. Fullness, with regards to pleating, indicates an amount of pleating given an overall unpleated width of the tool. For example, a layer with 0% fullness would be a flat surface whereas a substrate with 100% fullness is creased such that the pleated length is exactly half the unpleated length of the layer. For example, if the unpleated length of the tool was four (4) inches, and the pleated length was two (2) inches, the tool would have 100% fullness. If the unpleated length of the tool was four (4) inches and the pleated length was three (3) inches, the tool would have 50% fullness.

In pleated embodiments, the undulating application surface 202 may range from about 10% fullness to about 100%. In some embodiments, surface 202 may range between about 25% to about 100% fullness, between about 50% to about 100% fullness in some embodiments, between about 60% to about 100% fullness in some embodiments, between about 70% to about 100% fullness in some embodiments, between about 80% to about 100% fullness in some embodiments, and between about 90% to about 100% fullness in some embodiments.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "right hand," "left hand," "lateral," "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. For the purposes of the present disclosure, the phrase "at least one of A, B, and C," for example, means (A), (B), (C), (A and B), (A and C), (B and C), or (A, B, and C), including all further possible permutations when greater than three elements are listed.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A cosmetic tool, comprising:

a material body including a plurality of pleats that form an undulating application surface; and a handle coupled to the material body, wherein the plurality of pleats are selected from the group consisting of an organ pleat, a rolled pleat, an accordion pleat, and a crystal pleat.

2. The cosmetic tool of claim 1, further comprising:

a backing affixed to the material body, wherein the backing is arranged in pleats to cooperate with and support the plurality of pleats of the material body.

3. The cosmetic tool of claim 1, further comprising a substrate disposed in-between the material body and the handle.

4. The cosmetic tool of claim 3, wherein the substrate is one of a linear shape, a convex shape, and a concave shape.

5. The cosmetic tool of claim 3, wherein the substrate is flexible.

6. The cosmetic tool of claim 1, wherein the plurality of pleats are formed by a pleated fabric.

7. The cosmetic tool of claim 1, wherein a fullness of the pleats is between 10% fullness and 100% fullness.

8. The cosmetic tool of claim 1, wherein the plurality of pleats vary in height or depth.

9. A cosmetic tool comprising:

a mandrel;

an array of pleats on a first end of the mandrel; and a handle coupled to a second end of the mandrel, wherein the pleats are formed by a pleated fabric.

10. The cosmetic tool of claim 9, wherein the size of the pleats is non-constant.

11. The cosmetic tool of claim 10, wherein a height of the pleats varies around a perimeter of the mandrel.

12. A cosmetic tool comprising:

a substrate with a first side and a second side;

a material body attached to the first side of the substrate and defining a plurality of pleats that form an undulating contact surface, wherein the plurality of pleats are selected from the group consisting of an organ pleat, a rolled pleat, an accordion pleat, and a crystal pleat.

13. The cosmetic tool of claim 12, wherein the substrate is semi-rigid.

14. The cosmetic tool of claim 12, wherein the substrate is rigid.

15. The cosmetic tool of claim 12, further comprising a handle attached to the second side of the substrate.

16. The cosmetic tool of claim 12, wherein the material body includes one or more fabrics.

* * * * *